US006743304B2

(12) United States Patent
Kawamata et al.

(10) Patent No.: US 6,743,304 B2
(45) Date of Patent: Jun. 1, 2004

(54) NON-ORIENTED ELECTRICAL STEEL SHEET WITH ULTRA-HIGH MAGNETIC FLUX DENSITY AND PRODUCTION METHOD THEREOF

(75) Inventors: Ryutaro Kawamata, Futtsu (JP); Takeshi Kubota, Futtsu (JP)

(73) Assignee: Nippon Steel Corporation, Tokyo (JP)

( * ) Notice: Subject to any disclaimer, the term of this patent is extended or adjusted under 35 U.S.C. 154(b) by 86 days.

(21) Appl. No.: 10/014,011

(22) Filed: Dec. 10, 2001

(65) Prior Publication Data

US 2002/0153063 A1 Oct. 24, 2002

(30) Foreign Application Priority Data

Dec. 11, 2000 (JP) ..... 2000-376255
Mar. 23, 2001 (JP) ..... 2001-086147
Aug. 8, 2001 (JP) ..... 2001-241442

(51) Int. Cl.[7] ..... H01F 1/147
(52) U.S. Cl. ..... 148/306; 148/310; 420/87; 420/119
(58) Field of Search ..... 148/306, 310; 420/87, 119

(56) References Cited

U.S. PATENT DOCUMENTS 4,946,519 A * 8/1990 Honda et al. ..... 148/307
6,425,962 B1 * 7/2002 Kawamata et al. ..... 148/307

FOREIGN PATENT DOCUMENTS

| | | |
|---|---|---|
| JP | 54-76422 | 6/1979 |
| JP | 55-158252 | 12/1980 |
| JP | 57-35626 | 2/1982 |
| JP | 58-136718 | 8/1983 |
| JP | 59-100217 | 6/1984 |
| JP | 62-61644 | 12/1987 |
| JP | 6-271996 | 9/1994 |
| JP | H8-32927 | 3/1996 |
| JP | H8-109449 | 4/1996 |
| JP | H8-246108 | 9/1996 |
| JP | 62-180014 | 8/1997 |

* cited by examiner

*Primary Examiner*—John P. Sheehan
(74) *Attorney, Agent, or Firm*—Kenyon & Kenyon

(57) ABSTRACT

The present invention provides a non-oriented electrical steel sheet having ultra-high magnetic flux density and low core loss, characterized by: comprising a steel containing, in terms of wt %, Si: 0.4% or less, Ni: 2.0% to 6.0%, and Mn: 0.5% or less, with the balance consisting of Fe and unavoidable impurities; and having $B_{25}$, the magnetic flux density under the magnetic field strength of 2500 A/m, of 1.70T or higher and $B_{50}$, the magnetic flux density under the magnetic field strength of 5000 A/m, of 1.80T or higher.

13 Claims, 3 Drawing Sheets

NON-ORIENTED ELECTRICAL STEEL SHEET WITH ULTRA-HIGH MAGNETIC FLUX DENSITY AND PRODUCTION METHOD THEREOF

BACKGROUND OF THE INVENTION

1. Field of the Invention

The present invention relates to a non-oriented electrical steel sheet, which is used as an iron core material of an electrical apparatus, having unprecedentedly excellent magnetic properties such as exceedingly high magnetic flux density and low core loss, excellent formability such as excellent punching property, and excellent rust resistance to a product manufactured by using said non-oriented electrical steel sheet and to a production method thereof.

2. Description of the Related Art

In recent years, movements for improving efficiency are rapidly spreading in the field of electrical machinery and apparatuses, specifically rotating machinery and medium- and small-sized transformers, where non-oriented electrical steel sheets are used as iron core materials, amid the worldwide movement for the global environmental preservation, including the saving of electric power and energy and regulations against freon gas emission. For this reason, demands for improving the properties of non-oriented electrical steel sheets, namely, for higher magnetic flux density and lower core loss, are growing stronger.

The core loss reduction of a non-oriented electrical steel sheet has been carried out mainly by increasing the electrical resistivity through the addition of Si and Al and, by doing so, reducing the Joule heat loss caused by the loss of the eddy current that flows through each steel sheet constituting an iron core during its service.

However, among the energy losses of a rotating machine or an apparatus containing an iron core, the energy loss shared by copper loss, which is the Joule heat loss caused by the electric current flowing through a coiled wire wound round the core, cannot be neglected. In order to reduce the copper loss, it is effective to reduce the current density required to excite a core to a certain magnetic field strength, and therefore, the development of a material that exhibits a higher magnetic flux density with a same exciting current cannot be avoided. Namely, the development of a non-oriented electrical steel sheet having ultra-high magnetic flux density is essential.

By realizing a non-oriented electrical steel sheet having ultra-high magnetic flux density, it becomes possible to miniaturize both a rotating machine and an iron core and, for a movable body like an automobile or an electric car where a rotating machine and an iron core are mounted, it also becomes possible to reduce the energy loss during operation by the weight reduction of the whole body. Further, in case of a rotating machine, the torque is increased and a smaller-sized and higher-power rotating machine can be realized.

Thus, if a non-oriented electrical steel sheet having ultra-high magnetic flux density can be realized, not only the energy loss of an iron core and a rotating machine during their operation can be reduced, but also the pervasive effect inestimably extends to the entire equipment system incorporating them.

Conventional production methods of non-oriented electrical steel sheets having high magnetic flux density will be outlined. In Japanese Examined Patent Publication No. S62-61644, disclosed is a method of coarsening a crystal structure after hot-rolling by controlling the hot-rolling finishing temperature to 1000° C. or more, and also coarsening the crystal structure before cold-rolling while eliminating a finish-annealing process. However, in an actual finish hot rolling mill, there is a disadvantage of the difficulty in eliminating the uneven temperature distribution along the longitudinal direction of a steel coil and thus the magnetic properties varying along the longitudinal direction thereof, because the rolling speed at the time when rolls bite the tip of the steel coil is different from the one under a steady rolling state.

In the mean time, in Japanese Unexamined Patent Publication Nos. S54-76422 and S58-136718, disclosed is a method of self-annealing by coiling a hot-rolled steel sheet at a high temperature between 700° C. and 1000° C. and annealing the coil itself with the heat retained therein as a means to suppress a cost increase caused by the addition of a process for annealing the hot-rolled steel sheet and to coarsen the crystal structure before cold-rolling. In the embodiments of these patent publications, however, all of the self-annealing are carried out in the α-phase region for an identical reason, and the coarsening of the crystal structure before cold-rolling is limited.

Further, in Japanese Examined Patent Publication No. H8-32927, disclosed is a technology of pickling a hot-rolled steel sheet consisting of a steel material containing less than 0.01% of C, 0.5% to 3.0% of Si, 0.1% to 1.5% of Mn, 0.1% to 1.0% of Al, 0.005% to 0.016% of P and less than 0.005% of S, thereafter cold-rolling the pickled sheet at a cold reduction ratio of 5% to 20%, annealing the cold-rolled sheet for 0.5 to 10 minutes at a temperature between 850° C. and 1000° C., or for 1 to 10 hours at a temperature between 750° C. and 850° C., and then applying finish-annealing. This method is insufficient in improving magnetic flux density as compared to the conventional hot-rolled steel sheet annealing method and cannot meet the customers' demands for improving the magnetic properties of a non-oriented electrical steel sheet.

In addition, as the methods of improving the magnetic properties of non-oriented electrical steel sheets by improving the primarily re-crystallized texture, disclosed are the methods of manufacturing non-oriented electrical steel sheets excellent in magnetic properties by improving the texture with the addition of Sn in Japanese Unexamined Patent Publication No. S55-158252, Sn and Cu in Japanese Unexamined Patent Publication No. S62-180014, or Sb in Japanese Unexamined Patent Publication No. S59-100217.

However, even the addition of these texture controlling elements, like Sn, Cu or Sb, cannot satisfy the customers demands for a non-oriented electrical steel sheet having ultra-high magnetic flux density and low core loss.

As another method, the improvement in the production process such as devising a finish-annealing heat cycle is implemented as disclosed in Japanese Unexamined Patent Publication S57-35626. However, the attempts reveal little effect on the magnetic flux density improvement, though core loss improvement is seen.

There are three known technologies for obtaining high magnetic flux density by adding Ni, as described below.

In Japanese Unexamined Patent Publication No. H6-271996, disclosed is a method of obtaining high magnetic flux density and low core loss by adding the elements of Sn, Sb, Cu and the like in addition to Ni. However, in actual production, there is a problem of increasing production cost since it is required to control the cooling rate in the two-phase region from the $A_{r3}$ point to the $A_{r1}$ point either after solidification by rapid cooling or by heating the material again to a temperature not less than the $A_{C3}$ transformation temperature after the rapid cooling. Further, in Japanese Unexamined Patent Publication No. H8-246108, disclosed is a material having high magnetic flux density and low anisotropy realized by the addition of Ni. However, in actual production, it is required to finish-anneal the material by heating it to a temperature not less than the $A_{C3}$ temperature, and therefore, there is a problem of easily deteriorating the core loss on account of the internal oxidation of the Ni-added steel. In addition, in Japanese Unexamined Patent Publication No. H8-109449, disclosed are a material claiming to have high magnetic flux density and low anisotropy by adding Ni and its production method. However, in the actual production method, the annealing of a hot-rolled steel sheet or the self annealing of the same is essential, and the problem of easily deteriorating the core loss on account of the occurrence of the internal oxidization of Ni during the annealing cannot be solved.

As described above, the conventional technologies can not produce a non-oriented electrical steel sheet having not only low core loss but also ultra-high magnetic flux density, and therefore can not satisfy the above-described demands for a non-oriented electrical steel sheet.

SUMMARY OF THE INVENTION

The present invention is characterized not only by furnishing an Ni-added steel with ultra-high magnetic flux density, but also by offering a low cost process capable of achieving ultra-high magnetic flux density and low anisotropy without requiring any particular heat treatment, and this feature can be attained by reducing the amounts of added alloys except Ni and adding P. Further, the internal oxidization of Ni can be prevented by applying finish-annealing at a low temperature in the α-phase region, and by doing so, it becomes possible to make $B_{25}$, which is the magnetic flux density at the magnetic field strength of 2500 A/m and is lower than $B_{50}$, to 1.70T or higher, and at the same time, to make $B_{25R}$, which is the magnetic flux density calculated by the equation (2), to 1.65T or higher for the first time.

In the present invention, the addition of Ni and the control of the addition of Si, Al and Mn can remarkably enhance the marine weather resistance against sodium chloride and the like, in particular, by making dense the inner layer portions of the rust layers in the steel sheet surface layers and thus by suppressing the intrusion of chloride ions. Further, it has also become clear that the addition of P in an appropriate amount can further enhance the rust resistance which has been brought forth by the addition of Ni.

In addition, in the present invention, it is newly found that Nb which has been added in the conventional weather resistant steel remarkably deteriorates the magnetic flux density of a non-oriented electrical steel sheet, and by controlling the addition amount of Nb, a non-oriented electrical steel sheet with ultra-high magnetic flux density having rust resistance, weather resistance and magnetic properties together can be successfully developed.

Thanks to the above development, a non-oriented electrical steel sheet having ultra-high magnetic flux density according to the present invention can be processed and stored even in a plant and the like located in the environments near a seashore which have been inappropriate for the processing of a conventional non-oriented electrical steel sheet. At the same time, rusting during transportation can also be prevented and that is an advantage in simplifying the packaging.

Furthermore, in case of a magnetic switch core, the rust resistance of the bare surface of a metal is important since the end face of a switch is subject to an impact every time the switch operates, and therefore, required is a measure such as enclosing the switch itself in a special casing in the environment where the switch is likely to be exposed to sodium chloride and the like. However, by employing a non-oriented electrical steel sheet having ultra-high magnetic density and rust resistance according to the present invention, it becomes possible to use a magnetic switch in a corrosive environment where it has hardly been used so far.

Further, by employing a non-oriented electrical steel having ultra-high magnetic flux density and rust resistance according to the present invention, a magnetic switch can be miniaturized and the attractive force is also enhanced since a strong attractive force can be obtained by the effect of the ultra-high magnetic flux density even if the exciting current or the number of the windings of a wire is reduced.

The object of the present invention is to solve the problems of the conventional technologies and to provide a non-oriented electrical steel sheet having ultra-high magnetic flux density and low core loss.

The gist of the present invention is as follows:

(1) A non-oriented electrical steel sheet having ultra-high magnetic flux density, characterized by:

comprising a steel containing, in terms of wt %,
Si: 0.4% or less,
Ni: 2.0% to 6.0%,
Mn: 0.5% or less, and
P: 0.01% to 0.2%, with the balance consisting of Fe and unavoidable impurities; and having a magnetic flux density $B_{25}$ of 1.70T or higher and a magnetic flux density $B_{50}$ of 1.80T or higher.

(2) A non-oriented electrical steel sheet having ultra-high magnetic flux density and low magnetic anisotropy, characterized by:

comprising a steel containing, in terms of wt %,
Si: 0.4% or less,
Ni: 2.0% to 6.0%,
Mn: 0.5% or less, and
P: 0.01% to 0.2%, with the balance consisting of Fe and unavoidable impurities; having a magnetic flux density $B_{25}$ of 1.70T or higher and a magnetic flux density $B_{50}$ of 1.80T or higher; and the difference between the magnetic flux density $B_{50}L$ measured merely for a sample in the longitudinal direction and the magnetic flux density $B_{50}C$ measured merely for a sample in the cross direction being 350 Gauss or less.

(3) A non-oriented electrical steel sheet having ultra-high magnetic flux density and low core loss, characterized by:

comprising a steel containing, in terms of wt %,
Si: 0.4% or less,
Ni: 2.0% to 6.0%,
Mn: 0.5% or less,
P: 0.01% to 0.2%, and further,
C: 0.003% or less,
S: 0.003% or less,
N: 0.003% or less, and
Ti+S+N: 0.005% or less, with the balance consisting of Fe and unavoidable impurities; and having a magnetic flux density $B_{25}$ of 1.70T or higher, a magnetic flux density $B_{50}$ of 1.80T or higher, and a core loss $W_{15/50}$ after pickling, cold-rolling and annealing of 8W/kg or less.

(4) A non-oriented electrical steel sheet having ultra-high magnetic flux density according to any one of the items (1) to (3), characterized by having a magnetic flux density $B_{50}$ of 1.82T or higher.

(5) A non-oriented electrical steel sheet having ultra-high magnetic flux density, characterized by:

comprising a steel containing, in terms of wt %,

Si: 0.4% or less,

Al: 0.5% or less,

Ni: 2.0% to 6.0%,

Mn: 0.5% or less, and

P: 0.01% to 0.2%, with the balance consisting of Fe and unavoidable impurities; and having a magnetic flux density $B_{25R}$, defined by the undermentioned equation (1) of 1.65T or higher and a magnetic flux density $B_{50R}$ defined by the undermentioned equation (2) of 1.75T or higher, $$B_{25R}=(B_{25\text{-}L}+2\times B_{25\text{-}22.5}+2\times B_{25\text{-}45}+2\times B_{25\text{-}67.5}+B_{25\text{-}C})/8 \quad (1),$$

where $B_{25\text{-}L}$: magnetic flux density under the magnetic field strength of 2500 A/m, measured for a sample cut out in the direction of rolling.

$B_{25\text{-}22.5}$: magnetic flux density under the magnetic field strength of 2500 A/m, measured for a sample cut out in the direction inclining at an angle of 22.5 degrees from the direction of rolling on a steel sheet surface.

$B_{25\text{-}45}$: magnetic flux density under the magnetic field strength of 2500 A/m, measured for a sample cut out in the direction inclining at an angle of 45 degrees from the direction of rolling on a steel sheet surface.

$B_{25\text{-}67.5}$: magnetic flux density under the magnetic field strength of 2500 A/m, measured for a sample cut out in the direction inclining at an angle of 67.5 degrees from the direction of rolling on a steel sheet surface.

$B_{25\text{-}C}$: magnetic flux density under the magnetic field strength of 2500 A/m, measured for a sample cut out in the direction perpendicular to the direction of rolling on a steel sheet surface, $$B_{50R}=(B_{50\text{-}L}+2\times B_{50\text{-}22.5}+2\times B_{50\text{-}45}+2\times B_{50\text{-}67.5}+B_{50\text{-}C})/8 \quad (2)$$

where $B_{50\text{-}L}$: magnetic flux density under the magnetic field strength of 5000 A/m, measured for a sample cut out in the direction of rolling.

$B_{50\text{-}22.5}$: magnetic flux density under the magnetic field strength of 5000 A/m, measured for a sample cut out in the direction inclining at an angle of 22.5 degrees from the direction of rolling on a steel sheet surface.

$B_{50\text{-}45}$: magnetic flux density under the magnetic field strength of 5000 A/m, measured for a sample cut out in the direction inclining at an angle of 45 degrees from the direction of rolling on a steel sheet surface.

$B_{50\text{-}67.5}$: magnetic flux density under the magnetic field strength of 5000 A/m, measured for a sample cut out in the direction inclining at an angle of 67.5 degrees from the direction of rolling on a steel sheet surface.

$B_{50\text{-}C}$: magnetic flux density under the magnetic field strength of 5000 A/m, measured for a sample cut out in the direction perpendicular to the direction of rolling on a steel sheet surface.

(6) A non-oriented electrical steel sheet having ultra-high magnetic flux density and low core loss, characterized by:

comprising a steel containing, in terms of wt %,

Si: 0.4% or less,

Al: 0.5% or less,

Ni: 2.0% to 6.0%,

Mn: 0.5% or less,

P: 0.01% to 0.2%, and further,

C: 0.003% or less,

S: 0.003% or less,

N: 0.003% or less, and

Ti+S+N: 0.005% or less, with the balance consisting of Fe and unavoidable impurities; and having a magnetic flux density $B_{25R}$ defined by the undermentioned equation (1) of 1.65T or higher, a magnetic flux density $B_{50R}$ defined by the undermentioned equation (2) of 1.75T or higher, and a core loss $W_{15/50}$ after pickling, cold-rolling and annealing of 8W/kg or less, $$B_{25R}=(B_{25\text{-}L}+2\times B_{25\text{-}22.5}+2\times B_{25\text{-}45}+2\times B_{25\text{-}67.5}+B_{25\text{-}C})/8 \quad (1),$$

where $B_{25\text{-}L}$: magnetic flux density under the magnetic field strength of 2500 A/m, measured for a sample cut out in the direction of rolling.

$B_{25\text{-}22.5}$: magnetic flux density under the magnetic field strength of 2500 A/m, measured for a sample cut out in the direction inclining at an angle of 22.5 degrees from the direction of rolling on a steel sheet surface.

$B_{25\text{-}45}$: magnetic flux density under the magnetic field strength of 2500 A/m, measured for a sample cut out in the direction inclining at an angle of 45 degrees from the direction of rolling on a steel sheet surface.

$B_{25\text{-}67.5}$: magnetic flux density under the magnetic field strength of 2500 A/m, measured for a sample cut out in the direction inclining at an angle of 67.5 degrees from the direction of rolling on a steel sheet surface.

$B_{25\text{-}C}$: magnetic flux density under the magnetic field strength of 2500 A/m, measured for a sample cut out in the direction perpendicular to the direction of rolling on a steel sheet surface, $$B_{50R}=(B_{50\text{-}L}+2\times B_{50\text{-}22.5}+2\times B_{50\text{-}45}+2\times B_{50\text{-}67.5}+B_{50\text{-}C})/8 \quad (2),$$

where $B_{50\text{-}L}$: magnetic flux density under the magnetic field strength of 5000 A/m, measured for a sample cut out in the direction of rolling.

$B_{50\text{-}22.5}$: magnetic flux density under the magnetic field strength of 5000 A/m, measured for a sample cut out in the direction inclining at an angle of 22.5 degrees from the direction of rolling on a steel sheet surface.

$B_{50\text{-}45}$: magnetic flux density under the magnetic field strength of 5000 A/m, measured for a sample cut out in the direction inclining at an angle of 45 degrees from the direction of rolling on a steel sheet surface.

$B_{50\text{-}67.5}$: magnetic flux density under the magnetic field strength of 5000 A/m, measured for a sample cut out in the direction inclining at an angle of 67.5 degrees from the direction of rolling on a steel sheet surface.

$B_{50\text{-}C}$: magnetic flux density under the magnetic field strength of 5000 A/m, measured for a sample cut out in the direction perpendicular to the direction of rolling on a steel sheet surface.

(7) A non-oriented electrical steel sheet having ultra-high magnetic flux density and low core loss according to the item (5) or (6), characterized by having the magnetic flux density $B_{50R}$ of 1.79T or higher.

(8) An iron core excellent in punching property used for any one of; a rotator and a stator of a rotating machine, a reactor, a ballast, a choke coil, an EI core and a transformer: characterized by manufactured using a non-oriented electrical steel sheet according to any one of the items (1) to (7).

(9) A magnetic shielding apparatus characterized by manufactured using a non-oriented electrical steel sheet according to any one of the items (1) to (7).

(10) A non-oriented electrical steel sheet having ultra-high magnetic flux density and composed of a just cubic texture, characterized in that the strength standardized at the locations of $\alpha$=90°, $\beta$=90° and 270° in the (100) complete pole figure of the layer located in the center of the sheet thickness is 0.5 or higher.

(11) A non-oriented electrical steel sheet having ultra-high magnetic flux density and composed of just a cubic texture, characterized in that the strength standardized at the locations of $\alpha$=90°, $\beta$=90° and 270° in the (100) complete pole figure of the layer located at the depth of one fifth of the sheet thickness from the surface is 0.5 or higher.

(12) A production method of a non-oriented electrical steel sheet having ultra-high magnetic flux density characterized by: using a slab containing chemical components specified in any one of the items (1), (2), (3), (5) and (6), with the balance consisting of Fe and unavoidable impurities; hot-rolling said slab to a hot-rolled steel sheet; cold-rolling said steel sheet once after pickling; and then applying finish-annealing.

(13) A production method of a non-oriented electrical steel sheet having ultra-high magnetic flux density according to the item (12), characterized by applying the finish-annealing in the $\alpha$-phase region.

(14) A non-oriented electrical steel sheet having ultra-high magnetic flux density, excellent rust resistance and excellent weather resistance according to any one of the items (1) to (7), characterized in that the content of Nb is less than 0.005 wt %.

(15) An iron core for a magnet switch excellent in rust resistance and weather resistance, characterized by manufactured using either a non-oriented electrical steel sheet according to the item (10) or (11) having the Nb content of less than 0.005 wt % or a non-oriented electrical steel sheet according to the item (14).

DESCRIPTION OF THE PREFERRED EMBODIMENT

Figure 1:
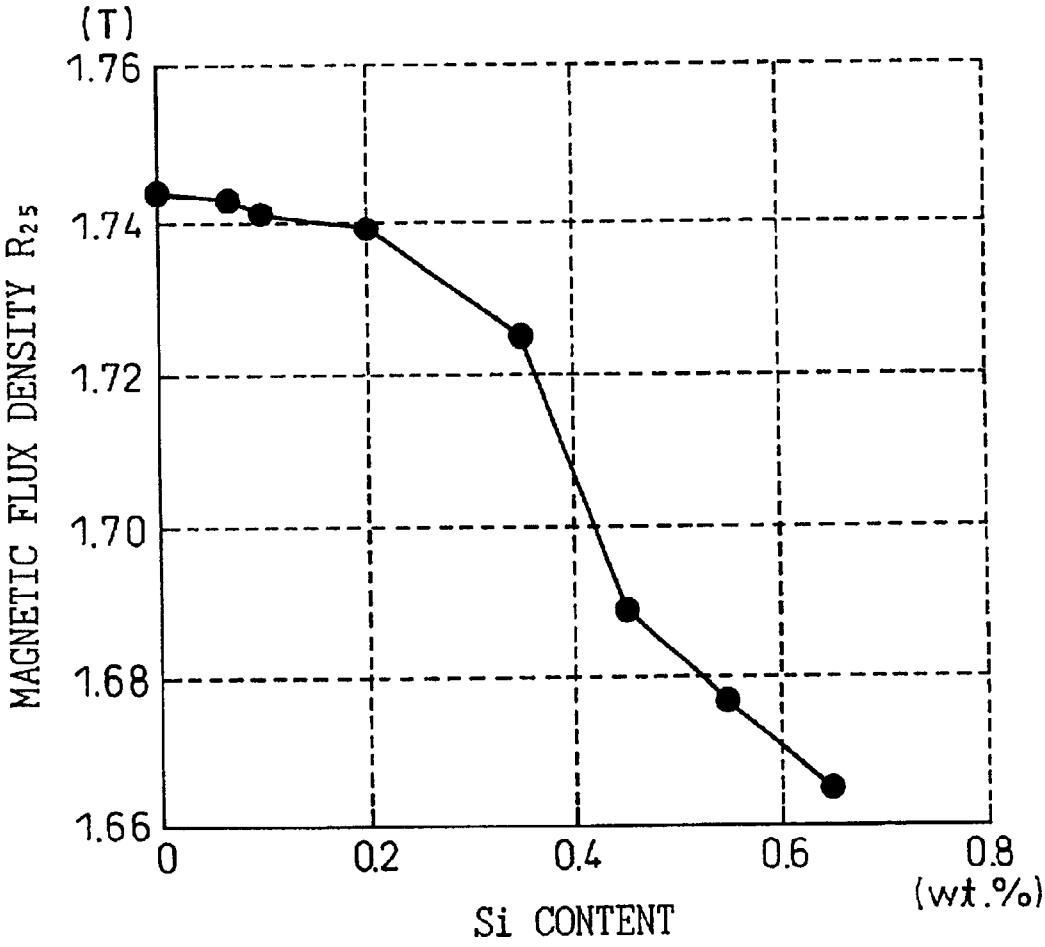
FIG. 1 is a graph showing the relationship between the Si content and the magnetic flux density $B_{25}$ of a steel containing 3% of Ni.

The present inventors, as a result of the extensive study to achieve ultra-high magnetic flux density unprecedented in the past, newly found that elements such as Si, Mn and Al that had been added conventionally to improve the magnetic properties of a non-oriented electrical steel sheet were rather detrimental to the attainment of ultra-high magnetic flux density. Further, the present inventors newly found that these elements remarkably deteriorated not only the magnetic flux density $B_{50}$ under a magnetic field strength of 5000 A/m, which had been conventionally used as an evaluation index of magnetic flux density, but also the magnetization property under a low magnetic field strength, and thus completed the present invention.

In addition, the present inventors found that the addition of P in a small amount was effective in improving magnetic flux density and lowering the anisotropy, and additionally newly found that it is possible to attain both ultra-high magnetic density and low core loss at the same time, which could not be realized in the past, by maintaining the purity of a steel material above a certain level.

Further, the present inventors newly found that the heat treatment of a hot-rolled steel sheet, which had conventionally been considered to be essential in the production of a non-oriented electrical steel sheet having high magnetic flux density, was detrimental, on the contrary, from the viewpoint of improving core loss, and discovered an optimum manufacturing process.

Firstly, the chemical components are explained hereunder, wherein the content of each chemical component is expressed in terms of wt %.

The content of Si is controlled to 0.4% or less since Si deteriorates the magnetic flux density of a product according to the present invention and is detrimental thereto.

The content of Mn is controlled to 0.5% or less since Mn deteriorates the magnetic flux density of a product according to the present invention and is detrimental thereto.

The content of Al is basically controlled to the level of unavoidable impurities since Al deteriorates the magnetic flux density of a product according to the present invention and is detrimental thereto. However, the Al content of 0.5% or less is permitted particularly when a low core loss is desired.

The present invention was completed based on the new finding that Si and Al, which were added to a non-oriented electrical steel sheet to secure electrical resistance in the conventional technology, were remarkably detrimental to the attainment of high magnetic flux density under a low magnetic field in a Ni-added steel.

The harmfulness of Si against the magnetic flux density of an Ni-added non-oriented electrical steel sheet under a low magnetic field is explained hereunder based on an experiment.

Steel samples containing 0.0008% to 0.0009% of C, 0.1% of Mn, 0.001% of sol.Al, 3.0% of Ni, 0.07% of P, 0.0005% to 0.0007% of S, 0.0006% to 0.0008% of N and 0.0006% to 0.0008% of Ti, wherein Si contents were varied, were melted and cast to slabs. Here, it had been already confirmed that the property of ultra-high magnetic flux density obtained according to the present invention varied within less than 0.005T and was scarcely affected by the above chemical components, except Si, if they were controlled within those ranges.

These slabs were hot-rolled to the thickness of 2.5 mm, pickled, and then processed to cold-rolled steel sheets 0.5 mm in thickness in a conventional method. Epstein samples were cut out from the steel sheets after they were subjected to finish-annealing at 750° C. for 30 seconds and the magnetic flux density $B_{25}$ was measured.

The result of the measurement is shown in FIG. 1. As understood from FIG. 1, the magnetic flux density ($B_{25}$) under a low magnetic field decreases sharply to less than 1.70T when the Si content exceeds 0.4%. Likewise, Al is remarkably detrimental to the improvement of the magnetic flux density ($B_{25}$) under a low magnetic field, and therefor, it is necessary to control the Al content to 0.5% or less, preferably to less than 0.3%.

As a result of a further detailed study, it is clarified that it is preferable to control the total amount of Si+2Al to 0.5% or less for obtaining a higher magnetic flux density $B_{25}$ under a low magnetic field.

As described above, in the present invention, it is necessary to control the contents of Si and Al to less than 0.4% and to 0.5% or less respectively. Here, it has been already confirmed that the magnetic flux density obtained according to the present invention varies within less than 0.005T and is scarcely affected by the above chemical components, except Si, if they are controlled within those ranges.

P is necessary for achieving ultra-high magnetic flux density $B_{50}$ of 1.80T or higher in the present invention, and is added in an amount ranging from 0.01% to 0.2% so that, in addition to the above, the difference between the magnetic flux density $B_{50}L$ measured merely for an L direction sample and the magnetic flux density $B_{50}C$ measured merely for a C direction sample, namely, the difference of the magnetic flux density $B_{50}$ in L direction and C direction, is 350 Gauss or less.

P content is specified to be 0.01% or higher since the difference of the magnetic flux density $B_{50}$ in L direction and C direction does not become 350 Gauss or less if the P content is less than 0.01%. Further, P content P is specified to be 0.2% or less since the magnetic flux density deteriorates if the P content exceeds 0.2%.

It is necessary to control the C content to 0.003% or less since magnetic aging occurs and core loss deteriorates during service if the C content exceeds 0.003%.

According to the present invention, both ultra-high magnetic flux density and low core loss can be attained at the same time by reducing the contents of S and N. S and N partly redissolve into a slab during heating in a hot-rolling process, precipitate again as the fine precipitates of MnS and AlN during hot-rolling, suppress crystal grain growth during finish-annealing, and cause core loss to deteriorate. Therefore, it is necessary to control each of their contents to 0.003% or less.

It is necessary to control the Ti content so that the total amount of Ti, S and N is 0.005% or less since Ti forms nitride and sulfide and deteriorates the core loss of a product.

According to the present invention, it is necessary to control the Nb content to less than 0.005 wt %. Nb remarkably deteriorates magnetic flux density if the content is 0.005 wt % or higher. Therefore, the Nb content is specified to be less than 0.005 wt %.

In order to investigate the effect of Ni on the magnetic flux density of a non-oriented electrical steel sheet according to the present invention, the following experiment was carried out.

Steel materials containing 0.05% of P, 0.07% of Si, 0.12% of Mn, 0.001% of T—Al, 15 ppm of C, 17 ppm of N, 16 ppm of S, and Ni varying from 10 ppm to 7% were produced by refining and were subjected to finish hot rolling to produce the steel sheets 2.7 mm in thickness. The hot-rolled steel sheets were pickled and cold-rolled to the thickness of 0.5 mm, and were degreased and then annealed at 750° C. for 20 seconds. The magnetic properties were measured using the Epstein samples taken from the steel sheets.

As a result of the measurement, when the Ni content is less than 2.0%, the magnetic flux density $B_{50}$ does not reach 1.80T and the effect of improving magnetic flux density is not obtained, but when the Ni content exceeds 6.0%, in contrast, the magnetic flux density decreases, and therefore, the Ni content is specified to be from 2.0% to 6.0%.

In order to achieve ultra-high magnetic flux density of 1.82T or higher, it is more preferable to control the Ni content to 3.0% to 6.0%.

Next, process conditions are explained hereunder.

Steel slabs having aforementioned chemical compositions are produced either by continuous casting or by ingot-casting and slab-rolling after refined in a converter. The steel slabs are heated by a known method. These steel slabs are hot-rolled so as to have a prescribed thickness.

The present invention does not require the annealing of a hot-rolled steel sheet that has been required in the conventional method of producing a non-oriented electrical steel sheet having high magnetic flux density. A non-oriented electrical steel sheet having a chemical composition according to the present invention can provide ultra-high magnetic flux density by cooling the strip sheet after hot-rolling, and then coiling, pickling, cold-rolling the steel strip, and applying the recrystallizing annealing within the α-phase region to the steel strip. Here, if the recrystallizing annealing temperature exceeds the $A_{C1}$ point, $B_{25R}$ decreases to 1.65T or less.

A feature of the present invention is that the component of a just cube is predominant in the texture of a product sheet. Namely, the present invention is characterized in that the strength standardized at the locations of α=90°, β=90° and 270° in the (100) pole figure drawn by the reflection method and the permeation method using the samples taken from the layer located in the center of the sheet thickness and the layer located at the depth of one fifth of the sheet thickness is 0.5 or higher. Thanks to the feature, it becomes possible to obtain a non-oriented electrical steel sheet having ultra-high magnetic flux density, namely, $B_{25}$, which is the magnetic flux density under the low magnetic field of 2500 A/m, of 1.70T or higher and $B_{50}$, which is the magnetic flux density under the high magnetic field of 5000 A/m, of 1.80T or higher, and also having the low anisotropy of 350 Gauss or less at $B_{50}$.

EXAMPLE 1

Slabs for non-oriented electrical steel sheets containing the chemical components shown in Table 1 were heated by a conventional method, and were processed into the steel sheets 2.7 mm in thickness by hot-rolling. The steel sheets were pickled thereafter and were processed into the steel sheets 0.50 mm in thickness by cold-rolling. The steel sheets were annealed at 750° C. for 20 seconds in a continuous annealing furnace. Then the steel sheets were cut into Epstein test samples, and the magnetic properties thereof were measured. The chemical compositions according to the present invention and those of comparative examples are shown in Table 1, and the measurement results of the magnetic properties are shown in Table 2.

As is obvious from Tables 1 and 2, it is possible to realize a non-oriented electrical steel sheet having ultra-high magnetic flux density, more specifically, having the magnetic flux density $B_{50}$ of 1.80T or higher by adding an appropriate amount of Ni and processing the steel sheet under an appropriate processing condition, or having the magnetic flux density $B_{50}$ of 1.82T or higher by adding Ni in an amount of 3.0% or higher. Further, by reducing the addition amounts of Si, Mn and Al, $B_{25}$, which is the magnetic flux density under the low magnetic field, is improved to 1.70T or higher.

TABLE 1

(Components: wt %)

| Composition | C | Si | Ni | Mn | P | S | sol-Al | N | Ti | Remarks |
|---|---|---|---|---|---|---|---|---|---|---|
| 1 | 0.0017 | 0.07 | 0.1 | 0.12 | 0.05 | 0.0011 | 0.001 | 0.0011 | 0.0011 | Comparative example |
| 2 | 0.0015 | 0.07 | 1.0 | 0.12 | 0.05 | 0.0008 | 0.001 | 0.0009 | 0.0010 | Comparative example |
| 3 | 0.0015 | 0.07 | 2.0 | 0.11 | 0.05 | 0.0008 | 0.001 | 0.0009 | 0.0011 | Present invention |
| 4 | 0.0014 | 0.07 | 3.0 | 0.12 | 0.05 | 0.0008 | 0.001 | 0.0009 | 0.0011 | Present invention |
| 5 | 0.0018 | 0.07 | 4.0 | 0.12 | 0.05 | 0.0009 | 0.001 | 0.0008 | 0.0012 | Present invention |
| 6 | 0.0016 | 0.07 | 6.5 | 0.11 | 0.05 | 0.0011 | 0.001 | 0.0011 | 0.0011 | Comparative example |

TABLE 2

| Composition | $W_{15/50}$ (W/kg) | $B_{25}$ (T) | $B_{50}$ (T) | Remarks |
|---|---|---|---|---|
| 1 | 8.54 | 1.690 | 1.770 | Comparative example |
| 2 | 7.42 | 1.725 | 1.798 | Comparative example |
| 3 | 7.31 | 1.730 | 1.819 | Present invention |
| 4 | 6.90 | 1.742 | 1.844 | Present invention |
| 5 | 7.60 | 1.754 | 1.856 | Present invention |
| 6 | 9.11 | 1.695 | 1.790 | Comparative example |

EXAMPLE 2

Slabs for non-oriented electrical steel sheets containing the chemical components shown in Table 3 were heated by a conventional method, and were processed into the steel sheets 2.5 mm in thickness by hot-rolling. The steel sheets were pickled thereafter and were processed into the steel sheets 0.50 mm in thickness by cold-rolling. The steel sheets were annealed at 750° C. for 30 seconds in a continuous annealing furnace. Then the steel sheets were cut into Epstein test samples, and the magnetic properties thereof were measured. When measuring magnetic flux density, in addition to the measurement of the usual samples cut out in the L and C directions, the anisotropy of the magnetic flux density was investigated by measuring the difference $B_{50}LC$ between the magnetic flux density $B_{50}L$ measured merely for Epstein test samples cut out in the L direction and the magnetic flux density $B_{50}C$ measured merely for Epstein test samples cut out in the C direction.

The chemical compositions according to the present invention and those of comparative examples are shown in Table 3, and the measurement results of the magnetic properties are shown in Table 4.

As is obvious from Tables 3 and 4, it is possible to realize a material having ultra-high magnetic flux density and low magnetic anisotropy, wherein $B_{25}$, which is a magnetic property under the low magnetic field, is improved by reducing the addition amounts of Si, Mn and Al and the difference $B_{50}LC$, which is an index of the anisotropy of magnetic flux density, is reduced to 350 Gauss or less by controlling the range of P addition to 0.01% to 0.2%.

TABLE 3

(Components: wt %)

| Composition | C | Si | Ni | Mn | P | S | sol-Al | N | Ti | Remarks |
|---|---|---|---|---|---|---|---|---|---|---|
| 7 | 0.0014 | 0.07 | 3.5 | 0.11 | 0.005 | 0.0009 | 0.001 | 0.0008 | 0.0011 | Comparative example |
| 8 | 0.0013 | 0.07 | 3.5 | 0.11 | 0.025 | 0.0009 | 0.001 | 0.0009 | 0.0010 | Present invention |
| 9 | 0.0014 | 0.07 | 3.5 | 0.11 | 0.051 | 0.0008 | 0.001 | 0.0008 | 0.0010 | Present invention |
| 10 | 0.0014 | 0.07 | 3.5 | 0.12 | 0.070 | 0.0009 | 0.001 | 0.0008 | 0.0011 | Present invention |
| 11 | 0.0014 | 0.07 | 3.5 | 0.12 | 0.150 | 0.0008 | 0.001 | 0.0009 | 0.0011 | Present invention |
| 12 | 0.0013 | 0.07 | 3.5 | 0.11 | 0.250 | 0.0008 | 0.001 | 0.0008 | 0.0012 | Comparative example |

TABLE 4

| Composition | $W_{15/50}$ (W/kg) | $B_{25}$ (T) | $B_{50}$ (T) | $B_{50LC}$ difference (Gauss) | Remarks |
|---|---|---|---|---|---|
| 7 | 6.94 | 1.699 | 1.803 | 750 | Comparative example |

TABLE 4-continued

| Composition | $W_{15/50}$ (W/kg) | $B_{25}$ (T) | $B_{50}$ (T) | $B_{50LC}$ difference (Gauss) | Remarks |
|---|---|---|---|---|---|
| 8 | 6.92 | 1.742 | 1.843 | 320 | Present invention |
| 9 | 6.91 | 1.743 | 1.842 | 256 | Present invention |
| 10 | 6.93 | 1.744 | 1.842 | 230 | Present invention |
| 11 | 6.90 | 1.745 | 1.844 | 275 | Present invention |
| 12 | 6.91 | 1.698 | 1.799 | 270 | Comparative example |

EXAMPLE 3

Samples for permeation X-ray measurement and reflected X-ray measurement respectively were taken from the portions located in the center of the sheet thickness and the portions located at the depth of one fifth of the sheet thickness from the surface using the product samples having the chemical composition of No. 9 in Example 2, and (100) complete pole figures were prepared.

Figure 2:
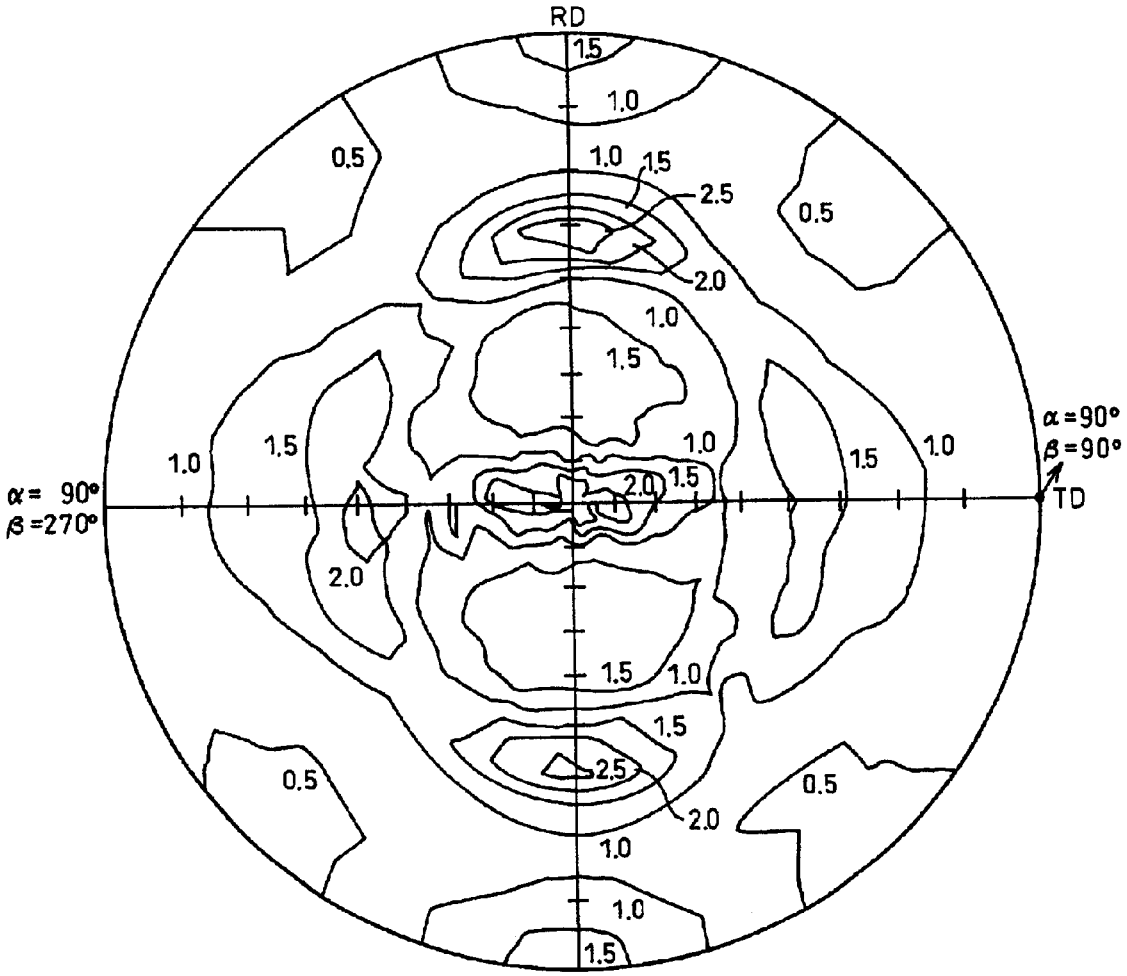
FIG. 2 is a sketch showing the (100) complete pole figure of the layer in the center of the sheet thickness of a product embodied according to the present invention.
Figure 3:
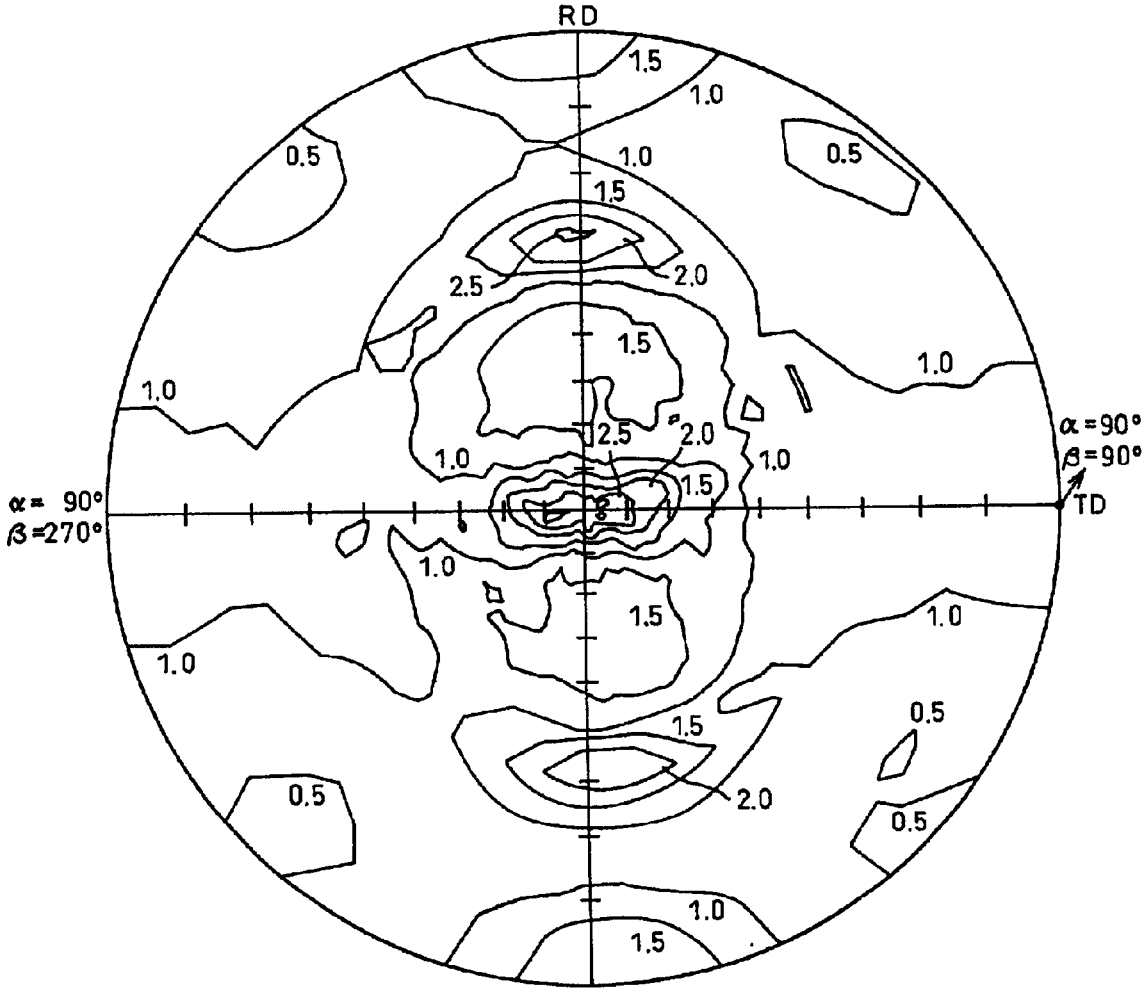
FIG. 3 is a sketch showing the (100) complete pole figure of the layer located at the depth of one fifth of the sheet thickness from the surface of a product embodied according to the present invention.

FIG. 2 shows the (100) complete pole figure of the sample taken from the layer located in the center of the sheet thickness, and FIG. 3 shows the (100) complete pole figure of the sample taken from the layer located at the depth of one fifth of the sheet thickness from the surface.

It is a feature of those figures that the strength at the locations of $\alpha$=90°, $\beta$=90° and 270° is 0.5 or higher in terms of the ratio to the random strength. Thanks to the feature, it becomes possible to obtain a non-oriented electrical steel sheet having ultra-high magnetic flux density, namely, $B_{25}$, which is the magnetic flux density under the low magnetic field of 2500 A/m, of 1.70T or higher and $B_{50}$, which is the magnetic flux density under the high magnetic field of 5000 A/m, of 1.80T or higher, and also having the low anisotropy of 350 Gauss or less at $B_{50}$.

EXAMPLE 4

Slabs for non-oriented electrical steel sheets containing the chemical components shown in Table 5 were heated by a conventional method, and were processed into the steel sheets 2.7 mm in thickness by hot-rolling. The steel sheets were pickled thereafter and were processed into the steel sheets 0.50 mm in thickness by cold-rolling. The steel sheets were annealed at a temperature within the range of a phase for 20 seconds in a continuous annealing furnace. Then the steel sheets were cut into Epstein test samples of each angle, and the magnetic properties thereof were measured. The chemical compositions according to the present invention and those of comparative examples are shown in Table 5, and the measurement results of the magnetic properties are shown in Table 6.

As is shown in Tables 5 and 6, it is possible to realize a non-oriented electrical steel sheet having ultra-high magnetic flux density, more specifically, having the magnetic flux density $B_{50R}$ of 1.75T or higher and the core loss $W_{15/50}$ of 8.0 or less, by adding an appropriate amount of Ni and processing the steel sheet under an appropriate processing condition. Further, it is possible to realize a non-oriented electrical steel sheet having ultra-high magnetic flux density, namely, the magnetic flux density $B_{50}$ of 1.79T or higher, by adding Ni in an amount of 3.0% or higher. Further, by reducing the addition amounts of Si, Mn and Al, $B_{25R}$, which is the magnetic flux density under the low magnetic field, is improved to 1.65T or higher. Here, above-described $B_{25R}$ and $B_{50R}$ are the values obtained by the aforementioned equations (1) and (2).

TABLE 5

(Components: wt %)

| Composition | C | Si | Ni | Mn | P | S | sol-Al | N | Ti | Remarks |
|---|---|---|---|---|---|---|---|---|---|---|
| 13 | 0.0015 | 0.07 | 0.1 | 0.12 | 0.09 | 0.0008 | 0.001 | 0.0009 | 0.0009 | Comparative example |
| 14 | 0.0013 | 0.07 | 2.0 | 0.11 | 0.08 | 0.0008 | 0.001 | 0.0009 | 0.0009 | Present invention |
| 15 | 0.0012 | 0.07 | 3.0 | 0.12 | 0.08 | 0.0007 | 0.001 | 0.0008 | 0.0009 | Present invention |
| 16 | 0.0013 | 0.07 | 4.0 | 0.12 | 0.08 | 0.0006 | 0.001 | 0.0009 | 0.0008 | Present invention |
| 17 | 0.0012 | 0.07 | 5.0 | 0.12 | 0.07 | 0.0008 | 0.001 | 0.0008 | 0.0008 | Present invention |
| 18 | 0.0013 | 0.07 | 6.0 | 0.11 | 0.07 | 0.0009 | 0.001 | 0.0008 | 0.0008 | Present invention |
| 19 | 0.0014 | 0.07 | 7.0 | 0.11 | 0.07 | 0.0009 | 0.001 | 0.0009 | 0.0009 | Comparative example |

TABLE 6

| Composition | $W_{15/50}$ (W/kg) | $B_{25R}$ (T) | $B_{50R}$ (T) | Remarks |
|---|---|---|---|---|
| 13 | 8.637 | 1.637 | 1.732 | Comparative example |
| 14 | 7.398 | 1.690 | 1.789 | Present invention |
| 15 | 7.012 | 1.706 | 1.806 | Present invention |
| 16 | 8.890 | 1.729 | 1.831 | Present invention |
| 17 | 8.950 | 1.735 | 1.835 | Present invention |
| 18 | 7.010 | 1.740 | 1.841 | Present invention |
| 19 | 10.120 | 1.695 | 1.790 | Comparative example |

EXAMPLE 5

Slabs for non-oriented electrical steel sheets containing the chemical components shown in Table 7 were heated by a conventional method, and were processed into steel sheets 2.5 mm in thickness by hot-rolling. The steel sheets were pickled thereafter and were processed into the steel sheets 0.50 mm in thickness by cold-rolling. The steel sheets were annealed at the temperatures shown in Table 8 for 30 seconds in a continuous annealing furnace. Then the steel sheets were cut into Epstein test samples of each angle, and the magnetic properties thereof were measured. The chemical compositions according to the present invention and those of comparative examples are shown in Table 7 and the measurement results of the magnetic properties are shown in Table 8.

As is shown in Tables 7 and 8, the magnetic flux densities $B_{50R}$ and $B_{25R}$ improve by controlling the temperature range of finish annealing within the α-phase region, compared with the case that the annealing is carried out at a temperature within the α+γ two-phase region or the γ-phase region. In particular, $B_{25R}$ improves by controlling the temperature range of finish annealing within the α-phase region.

Here, above-described $B_{25R}$ and $B_{50R}$ are the values obtained by the aforementioned equations (1) and (2).

TABLE 7

(Components: wt %)

| Composition | C | Si | Ni | Mn | P | S | sol-Al | N | Ti |
|---|---|---|---|---|---|---|---|---|---|
| 20 | 0.0012 | 0.003 | 2.0 | 0.11 | 0.056 | 0.0009 | 0.030 | 0.0009 | 0.0008 |
| 21 | 0.0013 | 0.002 | 3.0 | 0.11 | 0.051 | 0.0008 | 0.031 | 0.0008 | 0.0009 |
| 22 | 0.0011 | 0.003 | 4.0 | 0.12 | 0.050 | 0.0009 | 0.032 | 0.0008 | 0.0009 |

TABLE 8

| Composition | Finish-annealing temperature (° C.) | Finish-annealing condition | $B_{25R}$ (T) | $B_{50R}$ (T) | Remarks |
|---|---|---|---|---|---|
| 20 | 750 | α-phase region | 1.692 | 1.789 | Present invention |
| 20 | 835 | α + γ two-phase region | 1.665 | 1.776 | Comparative example |
| 20 | 880 | γ-phase region | 1.644 | 1.769 | Comparative example |
| 21 | 750 | α-phase region | 1.707 | 1.807 | Present invention |
| 21 | 790 | α + γ two-phase region | 1.670 | 1.786 | Comparative example |
| 21 | 850 | γ-phase region | 1.647 | 1.777 | Comparative example |
| 22 | 720 | α-phase region | 1.730 | 1.834 | Present invention |
| 22 | 770 | α + γ two-phase region | 1.675 | 1.815 | Comparative example |
| 22 | 850 | γ-phase region | 1.648 | 1.799 | Comparative example |

EXAMPLE 6

Slabs for non-oriented electrical steel sheets containing the chemical components shown in Table 9 were heated by a conventional method, and were processed into the steel sheets 2.5 mm in thickness by hot-rolling. The steel sheets were pickled thereafter and were processed into the steel sheets 0.5 mm in thickness by cold-rolling. The steel sheets were annealed at 750° C. for 30 seconds in a continuous annealing furnace. Then the steel sheets were cut into Epstein test samples, and the magnetic properties thereof were measured. The measurement results of the magnetic properties are shown in Table 10. Then, from uncoated product sheets, samples 40 mm in width, 100 mm in length and 0.5 mm in thickness were cut out for exposure test and the samples 60 mm in width, 80 mm in length and 0.5 mm in thickness for a salt-spray test.

The exposure test was carried out at the salinity attachment rate of 0.5 mmd (mg/dm$^2$/day) for one year by placing the test samples so as to incline at an angle of 45° in the longitudinal direction. The result is shown in Table 11. Also, the salt spray test was carried out at the spraying temperature of 35° C. for five hours using a solution of sodium chloride 5% in concentration as specified by JIS Z2371, and the occurrence of rust on the steel surfaces was observed. The result is shown in Table 12.

It can be understood from Table 10 that the steel materials according to the present invention exhibit excellently high magnetic flux density of 1.70T or higher in $B_{25}$ and 1.82T or higher in $B_{50}$.

It can be understood from Table 11 that the steel materials having the chemical compositions of Nos. 24 and 25 according to the present invention exhibit rust resistance superior to that of the comparative steel material in the exposure test. Further, it can be understood from Table 12 that the steel materials having the chemical compositions of Nos. 24 and 25 according to the present invention exhibit rust resistance superior to that of the comparative steel material in the salt splay test.

TABLE 9

| Composition | C | Si | Ni | Mn | P | S | sol-Al | N | Ti | Nb | Remarks |
|---|---|---|---|---|---|---|---|---|---|---|---|
| 23 | 10 | 0.071 | 0.5 | 0.12 | 0.071 | 8 | 10 | 8 | 9 | 10 | Comparative example |
| 24 | 11 | 0.070 | 3.0 | 0.12 | 0.075 | 7 | 10 | 7 | 8 | 10 | Embodiment of the present invention |
| 25 | 9 | 0.069 | 4.0 | 0.12 | 0.075 | 6 | 10 | 8 | 7 | 10 | Embodiment of the present invention |

Each chemical component is expressed in terms of wt %, except C, S, sol-Al, N, Ti and Nb being expressed in terms of ppm.

TABLE 10

| Composition | $W_{15/50}$ | $B_{25}$ | $B_{50}$ | Remarks |
|---|---|---|---|---|
| 23 | 8.595 (W/kg) | 1.631 (T) | 1.731 (T) | Comparative example |
| 24 | 6.995 | 1.710 | 1.831 | Embodiment of the present invention |
| 25 | 6.880 | 1.730 | 1.832 | Embodiment of the present invention |

TABLE 11

| Composition | Corrosion rate (mdd) | Remarks |
|---|---|---|
| 23 | 155 | Comparative example |
| 24 | 20 | Embodiment of the present invention |

TABLE 11-continued

| Composition | Corrosion rate (mdd) | Remarks |
|---|---|---|
| 25 | 15 | Embodiment of the present invention |

TABLE 12

| Composition | Presence of rust |
|---|---|
| 23 | Rusted |
| 24 | Not rusted |
| 25 | Not rusted |

EXAMPLE 7

Slabs for non-oriented electrical steel sheets containing the chemical components shown in Table 13 were heated by a conventional method, and were processed into the steel sheets 2.5 mm in thickness by hot-rolling. The steel sheets were pickled thereafter and were processed into the steel sheets 0.5 mm in thickness by cold-rolling. The steel sheets were annealed at 750° C. for 30 seconds in a continuous annealing furnace.

Then the steel sheets were cut into Epstein test samples, and the magnetic properties thereof were measured. The measurement result of the magnetic properties is shown in Table 14.

From Table 13, it is understood that the magnetic flux density $B_{25}$ decreases remarkably when the Si content exceeds 0.4%.

TABLE 13

(Components: wt %)

| Composition | C | Si | Ni | Mn | P | S | sol-Al | N | Ti |
|---|---|---|---|---|---|---|---|---|---|
| 26 | 0.0008 | 0.070 | 2.0 | 0.11 | 0.075 | 0.0007 | 0.0010 | 0.0006 | 0.0008 |
| 27 | 0.0008 | 0.110 | 2.0 | 0.12 | 0.075 | 0.0008 | 0.0010 | 0.0007 | 0.0009 |
| 28 | 0.0007 | 0.250 | 2.0 | 0.12 | 0.075 | 0.0007 | 0.0010 | 0.0006 | 0.0009 |
| 29 | 0.0008 | 0.451 | 2.0 | 0.12 | 0.075 | 0.0006 | 0.0010 | 0.0007 | 0.0009 |
| 30 | 0.0009 | 0.069 | 3.0 | 0.12 | 0.070 | 0.0005 | 0.0010 | 0.0007 | 0.0008 |
| 31 | 0.0008 | 0.121 | 3.0 | 0.11 | 0.070 | 0.0006 | 0.0010 | 0.0005 | 0.0009 |
| 32 | 0.0009 | 0.271 | 3.0 | 0.12 | 0.070 | 0.0008 | 0.0010 | 0.0007 | 0.0008 |
| 33 | 0.0009 | 0.460 | 3.0 | 0.12 | 0.070 | 0.0007 | 0.0010 | 0.0008 | 0.0007 |
| 34 | 0.0009 | 0.70 | 4.0 | 0.11 | 0.070 | 0.0007 | 0.0010 | 0.0007 | 0.0008 |
| 35 | 0.0008 | 0.150 | 4.0 | 0.12 | 0.069 | 0.0008 | 0.0010 | 0.0006 | 0.0009 |
| 36 | 0.0007 | 0.333 | 4.0 | 0.12 | 0.070 | 0.0007 | 0.0010 | 0.0007 | 0.0008 |
| 37 | 0.0009 | 0.445 | 4.0 | 0.12 | 0.070 | 0.0008 | 0.0010 | 0.0007 | 0.0008 |

Note) The underlined numbers in the chemical composition column represent the comparative examples.

TABLE 14

| Composition | $W_{15/50}$ | $B_{25}$ | $B_{50}$ | Remarks |
|---|---|---|---|---|
| 26 | 7.397 | 1.731 | 1.819 | Embodiment of the present invention |
| 27 | 7.402 | 1.729 | 1.819 | Embodiment of the present invention |

TABLE 14-continued

| Composition | $W_{15/50}$ | $B_{25}$ | $B_{50}$ | Remarks |
|---|---|---|---|---|
| 28 | 7.410 | 1.724 | 1.819 | Embodiment of the present invention |
| 29 | 7.673 | 1.672 | 1.818 | Comparative example |
| 30 | 6.998 | 1.744 | 1.845 | Embodiment of the present invention |
| 31 | 7.002 | 1.742 | 1.845 | Embodiment of the present invention |
| 32 | 7.012 | 1.737 | 1.843 | Embodiment of the present invention |
| 33 | 7.100 | 1.678 | 1.840 | Comparative example |
| 34 | 6.881 | 1.755 | 1.860 | Embodiment of the present invention |
| 35 | 6.890 | 1.751 | 1.856 | Embodiment of the present invention |
| 36 | 6.950 | 1.745 | 1.854 | Embodiment of the present invention |
| 37 | 7.001 | 1.690 | 1.859 | Comparative example |

What is claimed is:

1. A non-oriented electrical steel sheet having ultra-high magnetic flux density, characterized by: comprising a steel containing, in terms of wt %, Si: 0.4% or less, Ni: 2.0% to 6.0%, Mn: 0.5% or less, and P: 0.01% to 0.2%, with the balance consisting of Fe and unavoidable impurities; and having a magnetic flux density $B_{25}$ of 1.70T or higher and a magnetic flux density $B_{50}$ of 1.80T or higher.

2. A non-oriented electrical steel sheet having ultra-high magnetic flux density and low magnetic anisotropy, characterized by:

comprising a steel containing, in terms of wt %,

Si: 0.4% or less,

Ni: 2.0% to 6.0%,

Mn: 0.5% or less, and

P: 0.01% to 0.2%, with the balance consisting of Fe and unavoidable impurities; having a magnetic flux density ±25 of 1.70T or higher and a magnetic flux density $B_{50}$ of 1.80T or higher; and the difference between the magnetic flux density $B_{50}L$ measured for a sample in the longitudinal direction and the magnetic flux density $B_{50}C$ measured for a sample in the cross direction being 350 Gauss or less.

3. A non-oriented electrical steel sheet having ultra-high magnetic flux density and low core loss, characterized by:

comprising a steel containing, in terms of wt %,

Si: 0.4% or less,

Ni: 2.0% to 6.0%,

Mn: 0.5% or less,

P: 0.01% to 0.2%, and further,

C: 0.003% or less,

S: 0.003% or less,

N: 0.003% or less, and

Ti+S+N: 0.005% or less, with the balance consisting of Fe and unavoidable impurities; and having a magnetic flux density $B_{25}$ of 1.70T or higher, a magnetic flux density $B_{50}$ of 1.80T or higher, and a core loss $W_{15/50}$ after pickling, cold-rolling and annealing of 8 W/kg or less.

4. A non-oriented electrical steel sheet having ultra-high magnetic flux density, characterized by:

comprising a steel containing, in terms of wt %,

Si: 0.4% or less,

Al: 0.5% or less,

Ni: 2.0% to 6.0%,

Mn: 0.5% or less, and

P: 0.01% to 0.2%, with the balance consisting of Fe and unavoidable impurities; and having a magnetic flux density $B_{25R}$ defined by the undermentioned equation (1) of 1.65T or higher and a magnetic flux density $B_{50R}$ defined by the undermentioned equation (2) of 1.75T or higher, $$B_{25R}=(B_{25\text{-}L}+2\times B_{25\text{-}22.5}+2\times B_{25\text{-}45}+2\times B_{25\text{-}67.5}+B_{25\text{-}C})/8 \quad (1),$$

where $B_{25\text{-}L}$: magnetic flux density under the magnetic field strength of 2500 A/m, measured for a sample cut out in the direction of rolling, $B_{25\text{-}22.5}$: magnetic flux density under the magnetic field strength of 2500 A/m, measured for a sample cut out in the direction inclining at an angle of 22.5 degrees from the direction of rolling on a steel sheet surface, $B_{25\text{-}45}$: magnetic flux density under the magnetic field strength of 2500 A/m, measured for a sample cut out in the direction inclining at an angle of 45 degrees from the direction of rolling on a steel sheet surface, $B_{25\text{-}67.5}$: magnetic flux density under the magnetic field strength of 2500 A/m, measured for a sample cut out in the direction inclining at an angle of 67.5 degrees from the direction of rolling on a steel sheet surface, $B_{25\text{-}C}$: magnetic flux density under the magnetic field strength of 2500 A/m, measured for a sample cut out in the direction perpendicular to the direction of rolling on a steel sheet surface, $$B_{50R}=(B_{50\text{-}L}+2\times B_{50\text{-}22.5}+2\times B_{50\text{-}45}+2\times B_{50\text{-}67.5}+B_{50\text{-}C})/8 \quad (2),$$

where $B_{50\text{-}L}$: magnetic flux density under the magnetic field strength of 5000 A/m, measured for a sample cut out in the direction of rolling, $B_{50\text{-}22.5}$: magnetic flux density under the magnetic field strength of 5000 A/m, measured for a sample cut out in the direction inclining at an angle of 22.5 degrees from the direction of rolling on a steel sheet surface, $B_{50\text{-}45}$: magnetic flux density under the magnetic field strength of 5000 A/m, measured for a sample cut out in the direction inclining at an angle of 45 degrees from the direction of rolling on a steel sheet surface, $B_{50\text{-}67.5}$: magnetic flux density under the magnetic field strength of 5000 A/m, measured for a sample cut out in the direction inclining at an angle of 67.5 degrees from the direction of rolling on a steel sheet surface, $B_{50\text{-}C}$: magnetic flux density under the magnetic field strength of 5000 A/m, measured for a sample cut out in the direction perpendicular to the direction of rolling on a steel sheet surface.

5. A non-oriented electrical steel sheet having ultra-high magnetic flux density and low core loss, characterized by:

comprising a steel containing, in terms of wt %,

Si: 0.4% or less,

Al: 0.5% or less,

Ni: 2.0% to 6.0%,

Mn: 0.5% or less,

P: 0.01% to 0.2%, and further,

C: 0.003% or less,

S: 0.003% or less,

N: 0.003% or less, and

Ti+S+N: 0.005% or less, with the balance consisting of Fe and unavoidable impurities; and having a magnetic flux density $B_{25R}$ defined by the undermentioned equation (1) of 1.65T or higher, a magnetic flux density $B_{50R}$ defined by the undermentioned equation (2) of 1.75T or higher, and a core loss $W_{15/25}$, after pickling, cold-rolling and annealing of 8 W/kg or less, $$B_{25R}=(B_{25\text{-}L}+2\times B_{25\text{-}22.5}+2\times B_{25\text{-}45}+2\times B_{25\text{-}67.5}+B_{25\text{-}C})/8 \quad (1),$$

where $B_{25\text{-}L}$: magnetic flux density under the magnetic field strength of 2500 A/m, measured for a sample cut out in the direction of rolling, $B_{25\text{-}22.5}$: magnetic flux density under the magnetic field strength of 2500 A/m, measured for a sample cut out in the direction inclining at an angle of 22.5 degrees from the direction of rolling on a steel sheet surface, $B_{25\text{-}45}$: magnetic flux density under the magnetic field strength of 2500 A/m, measured for a sample cut out in the direction inclining at an angle of 45 degrees from the direction of rolling on a steel sheet surface, $B_{25\text{-}67.5}$: magnetic flux density under the magnetic field strength of 2500A/m, measured for a sample cut out in the direction inclining at an angle of 67.5 degrees from the direction of rolling on a steel sheet surface, $B_{25\text{-}C}$: magnetic flux density under the magnetic field strength of 2500 A/m, measured for a sample cut out in the direction perpendicular to the direction of rolling on a steel sheet surface, $$B_{50R}=(B_{50\text{-}L}+2\times B_{50\text{-}22.5}+2\times B_{50\text{-}45}+2\times B_{50\text{-}67.5}+B_{50\text{-}C})/8 \quad (2),$$

where $B_{50\text{-}L}$: magnetic flux density under the magnetic field strength of 5000 A/m, measured for a sample cut out in the direction of rolling, $B_{50\text{-}22.5}$: magnetic flux density under the magnetic field strength of 5000 A/m, measured for a sample cut out in the direction inclining at an angle of 22.5 degrees from the direction of rolling on a steel sheet surface, $B_{50\text{-}45}$: magnetic flux density under the magnetic field strength of 5000 A/m, measured for a sample cut out in the direction inclining at an angle of 45 degrees from the direction of rolling on a steel sheet surface, $B_{50\text{-}67.5}$: magnetic flux density under the magnetic field strength of 5000A/m, measured for a sample cut out in the direction inclining at an angle of 67.5 degrees from the direction of rolling on a steel sheet surface, $B_{50\text{-}C}$: magnetic flux density under the magnetic field strength of 5000 A/m, measured for a sample cut out in the direction perpendicular to the direction of rolling on a steel sheet surface.

6. A non-oriented electrical steel sheet having ultra-high magnetic flux density according to claim 1, characterized by having a magnetic flux density $B_{50}$ of 1.82T or higher.

7. A non-oriented electrical steel sheet having ultra-high magnetic flux density according to claim 2, characterized by having a magnetic flux density $B_{50}$ of 1.82T or higher.

8. A non-oriented electrical steel sheet having ultra-high magnetic flux density according to claim 3, characterized by having a magnetic flux density $B_{50}$ of 1.82T or higher.

9. A non-oriented electrical steel sheet having ultra-high magnetic flux density and low core loss according to claim 4, characterized by having a magnetic flux density $B_{50R}$ of 1.79T or higher.

10. A non-oriented electrical steel sheet having ultra-high magnetic flux density and low core loss according to claim 5, characterized by having a magnetic flux density $B_{50R}$ of 1.79T or higher.

11. An iron core excellent in punching property comprising a non-oriented electrical steel sheet according to any one of claims 1, 2, 3, 4 and 5, said iron core disposed in any one of: a rotator and a stator of a rotating machine, a reactor, a ballast, a choke coil, an EI core and a transformer.

12. A magnetic shielding apparatus characterized by containing a non-oriented electrical steel sheet according to any one of claims 1, 2, 3, 4 and 5.

13. A non-oriented electrical steel sheet having ultra-high magnetic flux density, excellent rust resistance and excellent weather resistance according to any one of claims 1, 2, 3, 4 and 5, characterized in that the content of Nb is less than 0.005 wt %.

* * * * *

UNITED STATES PATENT AND TRADEMARK OFFICE

CERTIFICATE OF CORRECTION

PATENT NO. : 6,743,304 B2
DATED : June 1, 2004
INVENTOR(S) : Kawamata et al.

It is certified that error appears in the above-identified patent and that said Letters Patent is hereby corrected as shown below:

Column 19,
Line 45, change "±25" to -- $B_{25}$ --.

Column 21,
Line 11, change "$W_{15/25}$" to -- $W_{15/50}$ --.

Signed and Sealed this

Eleventh Day of October, 2005

JON W. DUDAS
*Director of the United States Patent and Trademark Office*